US007114592B1

(12) United States Patent
Gibson et al.

(10) Patent No.: US 7,114,592 B1
(45) Date of Patent: Oct. 3, 2006

(54) LADDER WITH MAGNETIC TOOL HOLDER PLATE

(76) Inventors: Joseph Gibson, 3364 Gerber Daisy La., Oviedo, FL (US) 32766; Lynn Hegan, 3364 Gerber Daisy La., Oviedo, FL (US) 32766

( * ) Notice: Subject to any disclaimer, the term of this patent is extended or adjusted under 35 U.S.C. 154(b) by 0 days.

(21) Appl. No.: 10/874,470

(22) Filed: Jun. 22, 2004

(51) Int. Cl.
*E06C 7/00* (2006.01)

(52) U.S. Cl. ..... 182/129; 248/210; 248/309.4; 335/285

(58) Field of Classification Search ..... 182/129; 248/210, 238, 206.5, 309.4; 335/285
See application file for complete search history.

(56) References Cited

U.S. PATENT DOCUMENTS

| | | | | |
|---|---|---|---|---|
| 2,457,421 | A | 12/1948 | Warren | |
| 2,958,019 | A | 10/1960 | Scholten et al. | |
| 3,110,847 | A | 11/1963 | Ott et al. | |
| 3,518,593 | A | 6/1970 | Hall | |
| 3,746,992 | A * | 7/1973 | Serembe | 335/285 |
| 4,287,676 | A * | 9/1981 | Weinhaus | 40/661.01 |
| 4,938,728 | A | 7/1990 | Callari | |
| 5,098,052 | A * | 3/1992 | Beck | 248/238 |
| 5,213,240 | A * | 5/1993 | Dietz et al. | 224/183 |
| 5,405,004 | A * | 4/1995 | Vest et al. | 206/350 |
| 5,760,668 | A | 6/1998 | Testa et al. | |
| 6,152,035 | A * | 11/2000 | Scholtz et al. | 101/389.1 |
| 6,267,277 | B1 | 7/2001 | Taylor | |
| 6,587,022 | B1 | 7/2003 | Devine | |
| 6,614,337 | B1 | 9/2003 | Winnard | |
| 6,698,699 | B1 * | 3/2004 | Bailey | 248/210 |
| 2002/0070137 | A1 * | 6/2002 | Hedges | 206/373 |
| 2004/0069916 | A1 * | 4/2004 | Cohen | 248/230.8 |

FOREIGN PATENT DOCUMENTS

| | | |
|---|---|---|
| FR | 2623560 | 5/1989 |

* cited by examiner

*Primary Examiner*—Alvin Chin-Shue
(74) *Attorney, Agent, or Firm*—Michael I. Kroll

(57) ABSTRACT

A magnetic tool holder for a ladder 14 providing means for holding the selective positioning of tools to the top step 24 of a ladder. The tool holder is comprised of a planar magnetic material 12 being substantially rectangular fixedly attached to the top step 24 of the ladder. The magnetic material 12 is positioned on the underside or topside of the top step 24 of the ladder and either fastened thereto by an adhesive compound 20 or threaded fasteners such as nut and bolt 22, 26.

6 Claims, 14 Drawing Sheets

LADDER WITH MAGNETIC TOOL HOLDER PLATE

BACKGROUND OF THE INVENTION

1. Field of the Invention

The present invention relates generally to tool holders and, more specifically, to a magnetic tool holder for a ladder providing means for holding the selective positioning of tools to the top platform of a ladder. The tool holder is comprised of a planar magnetic material being substantially rectangular fixedly attached to the top platform of said ladder. The magnetic material is positioned on the underneath or topside of the ladder and either fastened thereto by an adhesive compound or threaded fasteners such as nut and bolt.

2. Description of the Prior Art

There are other magnetic devices designed for holding the placement of articles. Typical of these is U.S. Pat. No. 2,457,421 issued to Warren on Dec. 28, 1948.

Another patent was issued to Scholten on Oct. 25, 1960 as U.S. Pat. No. 2,958,019. Yet another U.S. Pat. No. 3,110,847 was issued to Ott, et al. on Nov. 12, 1963 and still yet another was issued on Jun. 30, 1970 to Hall as U.S. Pat. No. 3,518,593.

Another patent was issued to Callari on Jul. 3, 1990 as U.S. Pat. No. 4,938,728. Yet another U.S. Pat. No. 5,098,052 was issued to Beck on Mar. 24, 1992. Another was issued to Testa, et al. on Jun. 2, 1998 as U.S. Pat. No. 5,760,668 and still yet another was issued on Jul. 31, 2001 to Taylor as U.S. Pat. No. 6,267,277.

Another patent was issued to Devine on Jul. 1, 2003 as U.S. Pat. No. 6,587,022. Yet another U.S. Pat. No. 6,614,337 was issued to Winnard on Sep. 2, 2003. Another was issued to Hedges on Jun. 13, 2002 as U.S. Patent Application Publication No. 2002/0070137 and still yet another was issued on May 26, 1989 to Jacques as French Patent No. FR2623560.

U.S. Pat. No. 2,457,421

Inventor: Charles W. Warren

Issued: Dec. 28, 1948

A desk type magnetic retainer for paper clips and the like comprising a housing of nonmagnetic material having a well therein with one portion of the well straight and having one end of the well closed at an acute angle to the axis of the well, a permanent magnet adapted to fit within the well and having one side thereof flatted to correspond with the straight portion of the well and having poles thereof aligned to fit against the end wall of the well, whereby the poles of the magnet will be aligned with the inclined well wall, and means for retaining the magnet within the well.

U.S. Pat. No. 2,958,019

Inventor: Richard A. Scholten

Issued: Oct. 25, 1960

A magnetic pad assembly comprising a plurality of wafer-type permanent magnets arranged in side-by side relation to provide a pair of planar magnetic faces said magnets being magnetized along their shortest dimension and having two other dimensions substantially longer than said shortest dimension, and being sufficiently close together to enable magnetic flux paths to be set up between adjoining magnets, said magnets being arranged so as to provide faces of the same magnetic polarity in a common plane, a plurality of ferromagnetic spacers between adjoining magnets, and a relatively flexible non-magnetic supporting member abutting all of said faces in one plane.

U.S. Pat. No. 3,110,847

Inventor: Richard J. Ott, et al.

Issued: Nov. 12, 1963

A magnetic surface plate comprising, flat, rigid and dimensionally stable body means including plastic material and a plywood member completely embedded and enclosed in said plastic material, said body: means including an upper section of said plastic material having substantial thickness and located above said plywood member, said body means having a generally rectangular peripheral configuration, and a plurality of substantially juxtaposed magnetic blocks embedded in said, upper section of said plastic material, said plastic material including portions extending into crevices between substantially abutting blocks, said blocks presenting upwardly facing surfaces combining with said portions and providing said surface plate with a substantially smooth planar upwardly facing work surface, and said blocks being arranged in a predetermined pattern having rows of blocks and having poles of the magnetic blocks disposed primarily adjacent opposite poles of adjacent blocks.

U.S. Pat. No. 3,518,593

Inventor: Bradley P. Hall

Issued: Feb. 26, 1968

A device for handling magnetic workpieces comprising: a first sheet having a plurality of discrete magnetic zones forming a two-dimensional matrix on the top surface of said first sheet, each said magnetic zone having the same polarization and having a greater magnetic field intensity at said top surface than at the bottom surface of said first sheet, the distance between the peak flux intensity lines of any two adjacent said magnetic zones being greater than the longest dimension of the magnetic work pieces to be handled; a nonmagnetic frame for holding said first sheet and for preventing the magnetic work pieces to be handled from gathering at the periphery of said device; a nonmagnetic base attached to said bottom surface of said first sheet and to the bottom of said nonmagnetic frame for supporting said first sheet; a nonmagnetic work layer joined to said top surface of said first sheet and to the top of said nonmagnetic frame for providing a smooth and durable working surface for said device; and the thickness of said nonmagnetic work layer and the intensity of said magnetic zones in said first sheet coating to generate a magnetic field at the surface of said nonmagnetic working layer of such a magnitude with relation to the size and weight of the magnetic work piece to be handled that only magnetic work pieces within a desired distance from said device will be attracted to said device.

U.S. Pat. No. 4,938,728

Inventor: Daniel T. Callari

Issued: Jul. 3, 1990

The present invention relates to an improved novelty device resembling a ladder. The device includes a base having rung guides located thereon. Spaced between the rung guides and above the base are a plurality of rungs having magnets located in the ends of each rung. The magnets and rung guides are arranged such that the rungs may freely travel between the rung guides, the rungs being separated by the repulsive forces of the magnets.

U.S. Pat. No. 5,098,052

Inventor: Daniel L. Beck

Issued: Mar. 24, 1992

A tray member is provided including at least one pair of opposite side margin depending flanges and a center downwardly recessed portion whose undersurface is co-planar with the lower edges of the depending flanges. The downwardly recessed center portion defines an upwardly opening recess in which to receive the lower end of a paint can and the tray member includes widely spaced apart depending threaded shanks from which a clamp bar is supported through the utilization of wing nuts threadedly engaged on the shanks. The tray member may be slid into position on the horizontal shelf of a step ladder and removably clamp engaged with the shelf by tightening the wing nuts in order to clamp the shelf between the clamp bar and the underside of the tray member. In addition, the upper surface of the downwardly recessed central portion of the tray member as well as the upper surfaces of the tray member disposed about the downwardly recessed central portion of the tray member are covered with magnetized panels, whereby ferris material items placed thereon will be magnetically held in position on the tray member.

U.S. Pat. No. 5,760,668

Inventor: Joseph F. Testa, et al.

Issued: Jun. 2, 1998

A casing with multiple bar magnets attached to the inner side of a casing back panel. A non-magnetic cover encloses the magnets in the casing and provides a flat surface for engaging tools and other objects. The casing has handles on the casing side panels to permit easy carrying and a means for hanging the casing in a variety of work locations.

U.S. Pat. No. 6,267,277

Inventor: Adam M. Taylor

Issued: Jul. 31, 2001

In accordance with the first embodiment of the invention there is provided a portable, flexible tool holder having a generally rectangular flexible body, the body having an inner surface and an outer surface and an upper edge, a lower edge and two side edges, the outer surface having a plurality of magnets connected thereto, the inner surface having a plurality of pockets an loops thereon for holding tools and equipment, either of the side edges being foldable toward the other of the side edges to enclose the inner surface of the body inside the outer surface of the body to tightly hold tools and equipment within the tool holder, and the upper edge having receivers for attaching a carrying device to the tool holder. In accordance with a second embodiment of the invention there is provided a portable tool holder having a generally rectangular body, the body having an inner surface and an outer surface, the outer surface having a plurality of magnets connected thereto, the inner surface having a pocket for holding welding rods and a strap assembly located beneath on the lower end of the pocket for holding tools and equipment, and the upper edge having a receiver for attaching a carrying device to the tool holder.

U.S. Pat. No. 6,587,022

Inventor: Rita M. Devine

Issued: Jul. 1, 2003

A foldable, portable, magnetic tool mat is disclosed. The tool mat includes generally rectangular obverse and reverse panels each formed of flexible material and connected together along substantially common side and end margins and along evenly spaced apart seam lines extending between said side margins defining elongated magnet bar holding portions. An elongated permanent magnet bar is held within each holding portion each without substantially inhibiting selective tool mat folding for fit and storage. The reverse panel is substantially thicker than the obverse panel for better wear characteristics and maximal magnetic attractive forces for tool and hardware retention. An attaching strap holds the tool mat.

U.S. Pat. No. 6,614,337

Inventor: Stanley D. Winnard

Issued: Sep. 2, 2003

A magnetic holding device for storing and organizing tools that are intrinsically or have been made magnetically conductive is disclosed that includes a first plate having a width, a thickness and at least one opening and a magnet having a first and a second magnetic region attached to the first plate, wherein the magnetic regions of the magnet are located on opposite sides of the at least one opening in the first plate.

U.S. Patent Application Publication Number 2002/0070137

Inventor: Kelley Hedges

Issued: Jun. 13, 2002

A tool and material holder fitting to the top of a step ladder has selectable detachable panels having and presenting an extremely large number of variously selectable pockets, cavities, loops, clips, hangers, hooks and the like which securely hold a great variety of power and hand tools, caulking guns, paint brushes and paint pads. The holder is stiffened by internal tubes and sheet preferably made from strong shape-retentive plastic, and will stand upright upon the floor. A major loop maintained open by an insert with a shape memory holds a large paint pail, bucket or can, and is optionally re-sizable to hold one or two smaller cans. A shallow reservoir on a top panel overlying the top step of the step ladder has a magnetic bottom for conveniently holding small ferrous items. A detachable strap and shoulder harness permits great loaded weight to be conveniently and safely carried.

French Patent Number FR2623560

Inventor: Mariot Jacques

Issued: May 26, 1989

A ladder which allows curved metal surfaces to be climbed. it is formed of two rubber uprights 1 connected by aluminum rungs 2. the flexible assembly is formed with screws integral with the permanently magnetic supports 3 and "Nylstop" nuts. The movable magnetic ladder is particularly designed to facilitate certain checks or works in a spiral casing of a hydraulic turbine.

While these magnetic devices may be suitable for the purposes for which they were designed, they would not be as suitable for the purposes of the present invention, as hereinafter described.

SUMMARY OF THE PRESENT INVENTION

The present invention discloses a magnetic tool holder for a ladder providing means for holding the selective positioning of tools to the top step of a ladder. The tool holder is comprised of a planar magnetic material being substantially rectangular fixedly attached to the top step of the ladder. The magnetic material is positioned on the underside or topside of the top step of the ladder and either fastened thereto by an adhesive compound or threaded fasteners such as nut and bolt.

A primary object of the present invention is to provide a tool holder for a ladder.

Another object of the present invention is to provide means for maintaining the positioning of tools upon the top of a ladder.

Yet another object of the present invention is to provide a tool holder that is fixedly fastened to the top step of a ladder.

Still yet another object of the present invention is to provide a tool holder comprised of a planar magnetic material.

Another object of the present invention is to provide a tool holder wherein said planar magnetic material is fastened to the top platform of a ladder.

Yet another object of the present invention is to provide a tool holder wherein said fastening means is adhesively.

Still yet another object of the present invention is to provide a tool holder wherein said fastening means is through the use of nut and bolt.

Another object of the present invention is to provide a tool holder wherein said magnetic planar material is fastened to the underside of the top step.

Yet another object of the present invention is to provide a tool holder wherein said magnetic planar material is fastened to the top side of the top step.

Additional objects of the present invention will appear as the description proceeds.

The present invention overcomes the shortcomings of the prior art by providing a magnetic tool holder for a ladder providing means for holding the selective positioning of tools to the top platform of a ladder. The tool holder is comprised of a planar magnetic material being substantially rectangular fixedly attached to the top platform of said ladder. The magnetic material is positioned on the underneath or topside of the ladder and either fastened thereto by an adhesive compound or threaded fasteners such as nut and bolt.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

LIST OF REFERENCE NUMERALS

Figure 1:
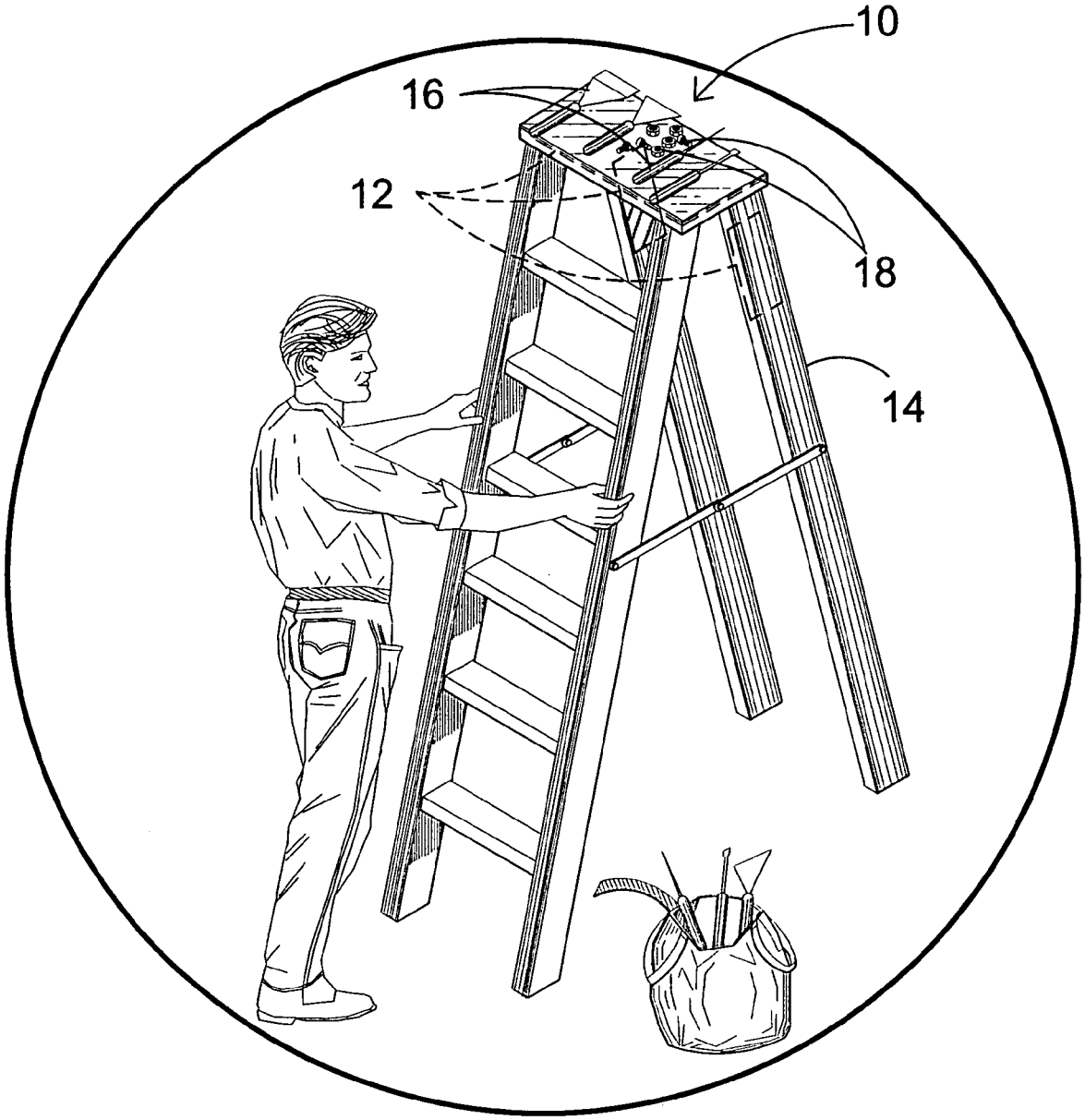
FIG. 1 is an illustrative view of the present invention in use.

With regard to reference numerals used, the following numbering is used throughout the drawings.

10 present invention
12 plate
14 ladder
16 tools

18 hardware
20 adhesive
22 screws
24 top step
26 nuts
28 magnetic donut

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a magnetic plate 12 that is fixedly attached to the under side of the top step of a ladder 14 by means of adhesive material or by recessed screws whereby ferriferous material items, e.g., tools 16 and hardware 18, placed thereon will be magnetically held in position on the magnetic plate. The device is designed to prevent items 16, 18 stored on the top step of a ladder from falling to the ground. Even if the ladder tips over, the ferriferous items 16, 18 upon the magnetic plate 12 will stay in place.

Figure 2:
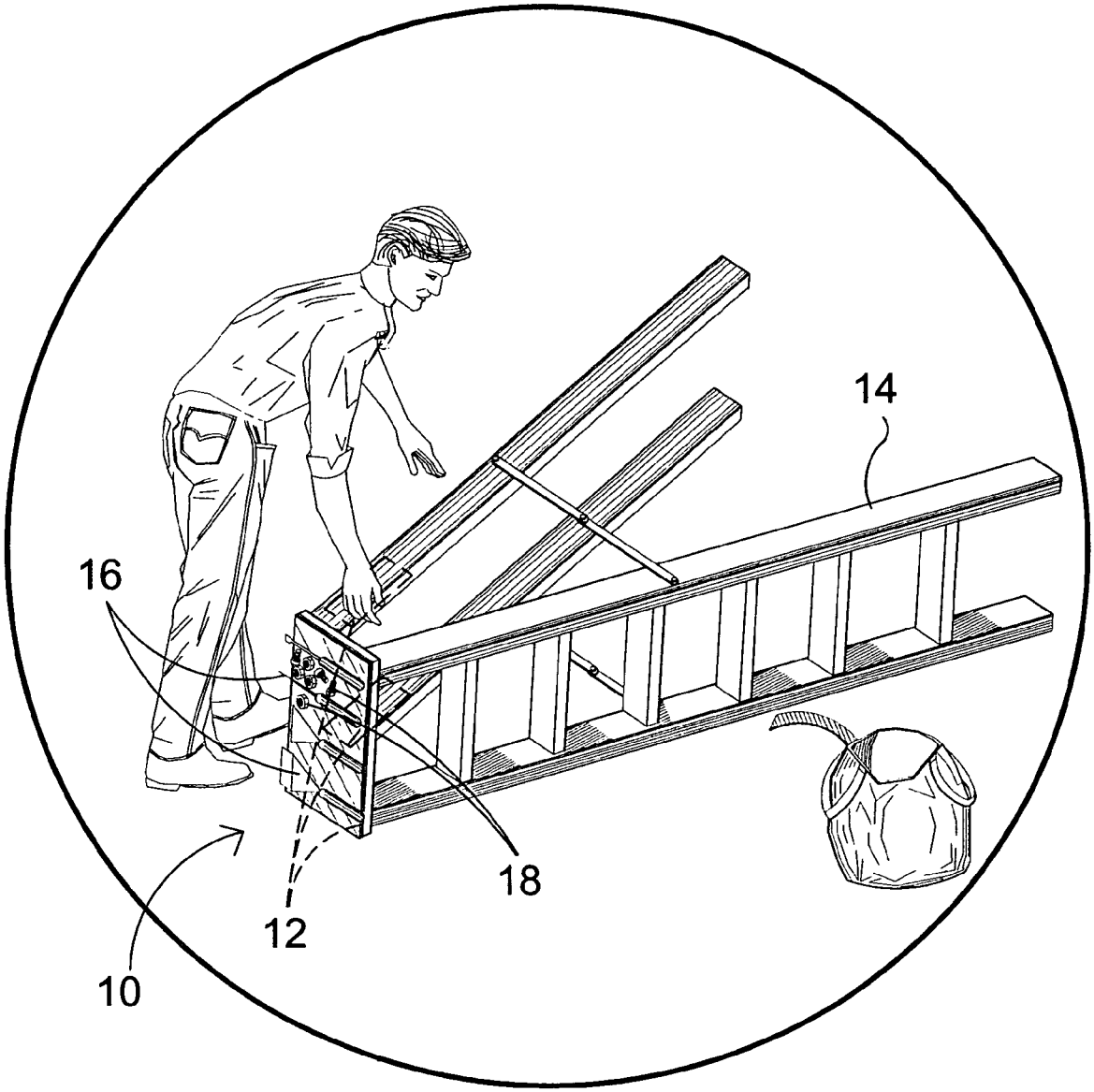
FIG. 2 is an illustrative view of the present invention in use.

Turning to FIG. 2, shown therein is an illustrative view of the present invention 10 in use. Shown is the present invention 10 being a magnetic plate 12 that is fixedly attached to the under side of the top step of a ladder 14 and having ferriferous material items 16, 18 placed thereon will be magnetically held in position on the magnetic plate. The device is designed to prevent items 16, 18 stored on the top step of a ladder from falling to the ground. Even if the ladder tips over, the ferriferous items 16, 18 upon the magnetic plate 12 will stay in place.

Figure 3:
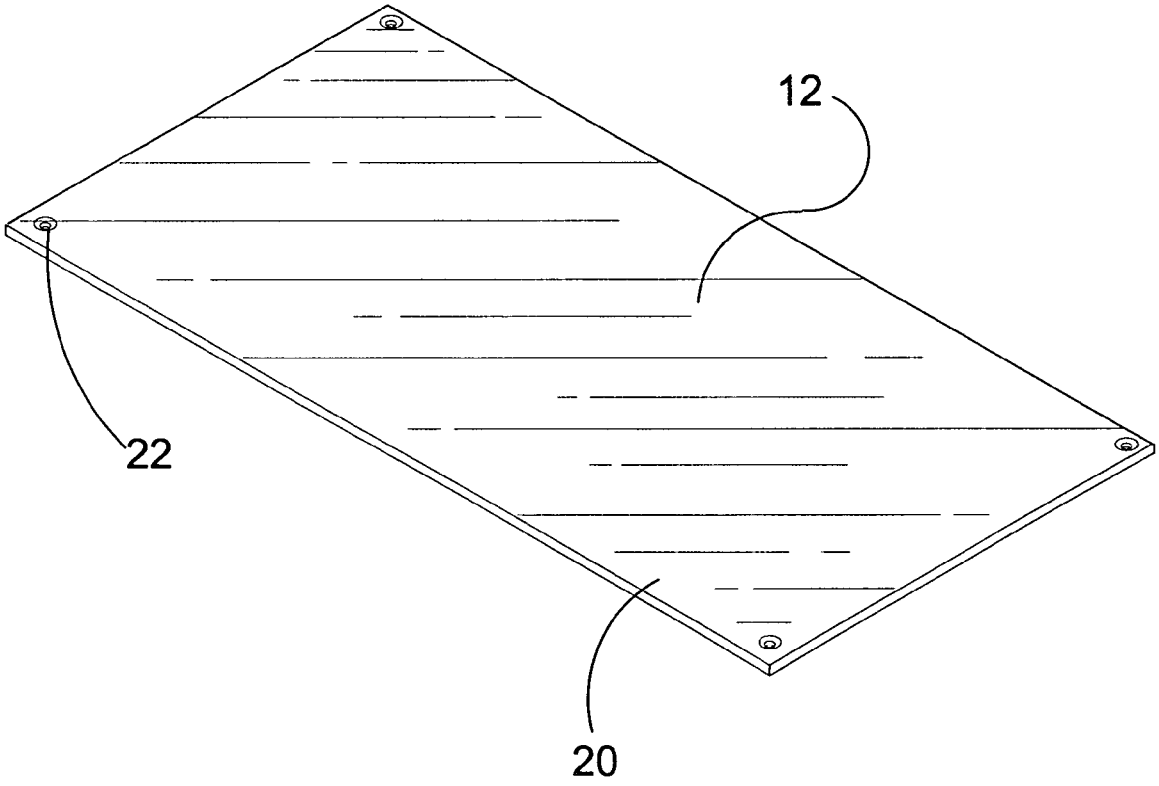
FIG. 3 is a perspective view of the present invention.

Turning to FIG. 3, shown therein is a perspective view of the present invention. Shown is a perspective view of the present invention being a magnetic plate 12 that is fixedly attached to the under side of the top step of a ladder. When ferriferous material items are placed thereon, they will be magnetically held in position on the magnetic plate. The magnetic plate can be adhesively attached at 20 to the top step of a ladder of can be attached by means of recessed screws 22.

Figure 4:
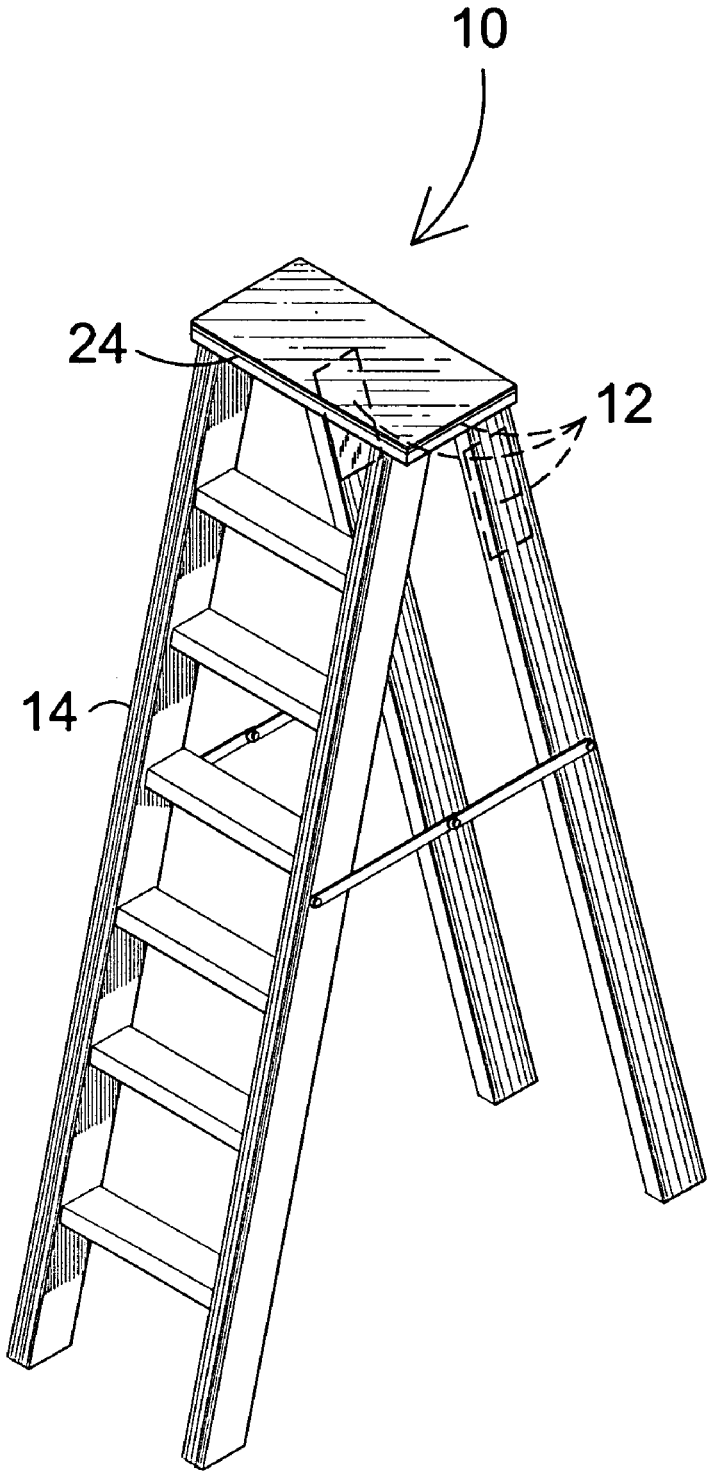
FIG. 4 is a perspective view of the present invention fixedly attached to a ladder's top step.

Turning to FIG. 4, shown therein is a perspective view of the present invention 10 fixedly attached to a ladder's 14 top step. Shown is the present invention 10 being a magnetic plate 12 that is fixedly attached to the under side of the top step 24 of a ladder 14. When ferriferous material items are placed thereon, they will be magnetically held in position on the magnetic plate 12. The magnetic plate 12 can be adhesively attached to the top step 24 of a ladder 14 of can be attached by means of recessed screws. The device 10 will prevent items placed thereon from rolling or falling off when a user is working on said ladder 14.

Figure 5:
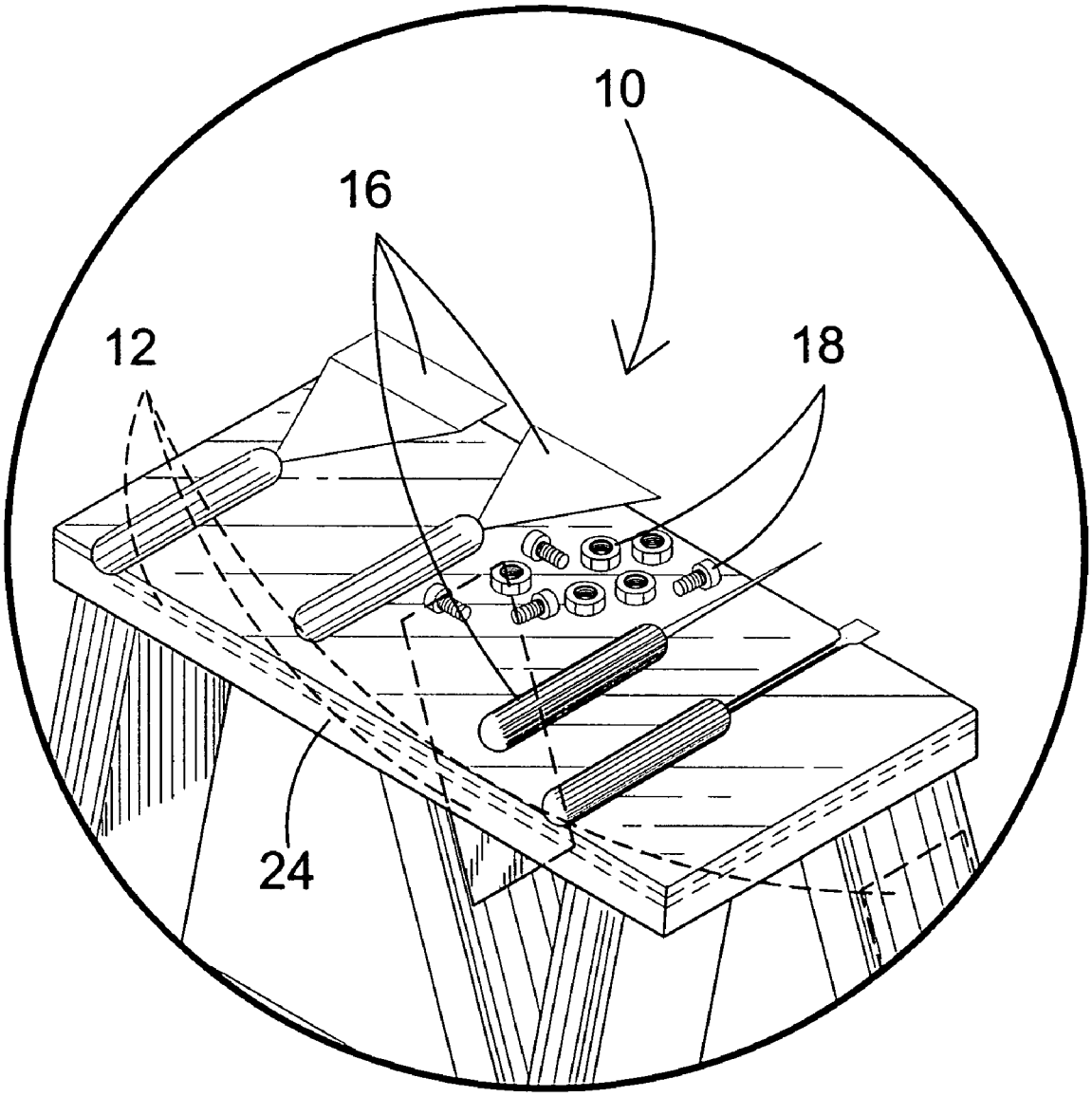
FIG. 5 is a detailed view of the present invention in use.

Turning to FIG. 5, shown therein is a detailed view of the present invention 10 in use. Shown is a detailed view of the present invention 10 being a magnetic plate 12 that is fixedly attached to the under side of the top step 24 of a ladder by means of adhesive material or by recessed screws whereby ferriferous material items 16, 18 placed thereon will be magnetically held in position on the magnetic plate. The device 10 is designed to prevent items 16, 18 stored on the top step 24 of a ladder from falling to the ground. Even if the ladder tips over, the ferriferous items 16, 18 upon the magnetic plate 12 will stay in place.

Figure 6:
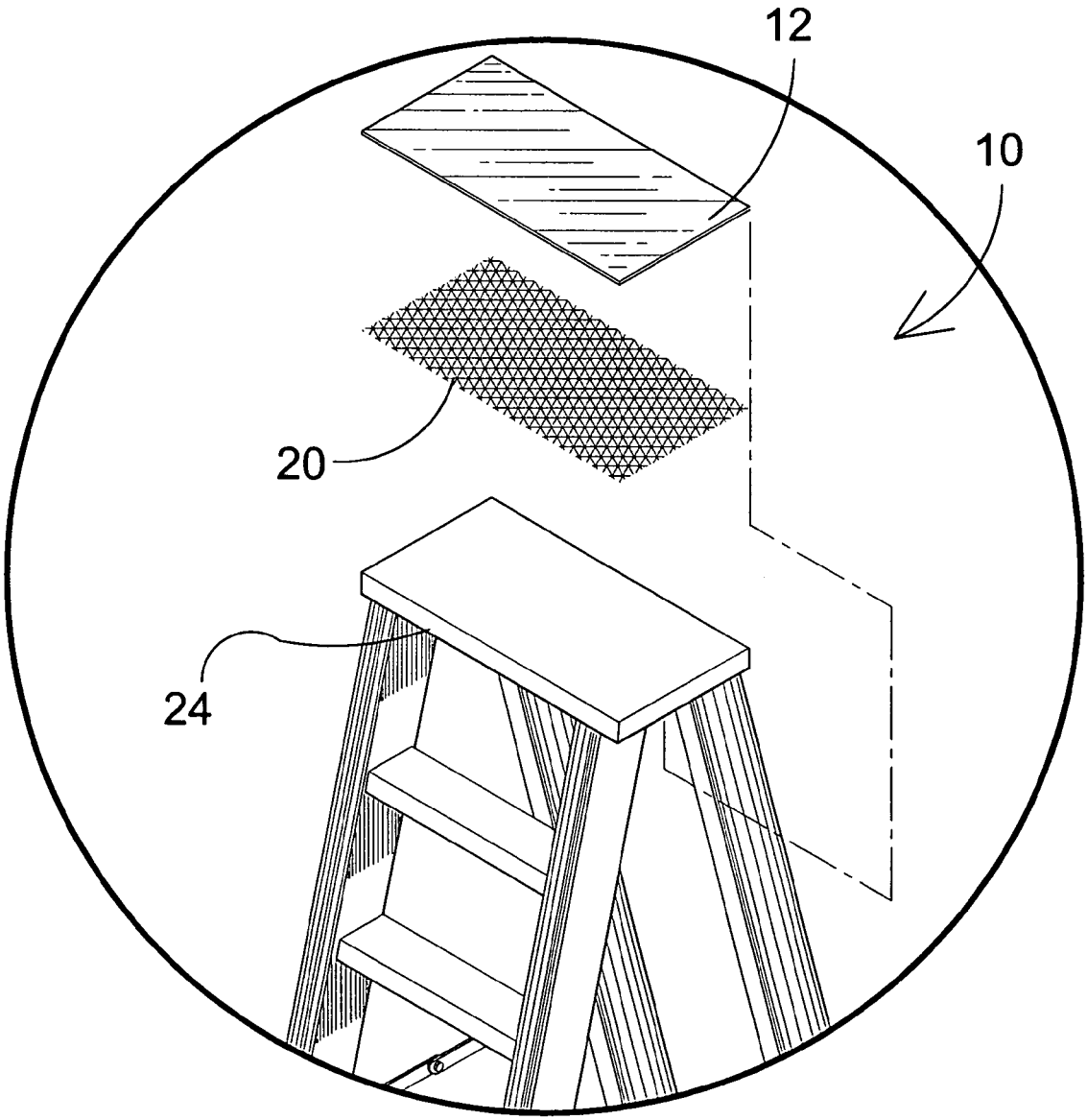
FIG. 6 is a detailed view of the present invention adhesively attached to the under side of the top step of a ladder.

Turning to FIG. 6, shown therein is a detailed view of the present invention 10 adhesively attached to the under side of the top step 24 of a ladder. Shown is a detailed view of the present invention 10 being a magnetic plate 12 that is fixedly attached to the under side of the top step 24 of a ladder by means of an adhesive material layer 20 whereby ferriferous material items placed thereon will be magnetically held in position on the magnetic plate 12. The device 10 is designed to prevent items stored on the top step of a ladder from falling to the ground. Even if the ladder tips over, the ferriferous items upon the magnetic plate 12 will stay in place.

Figure 7:
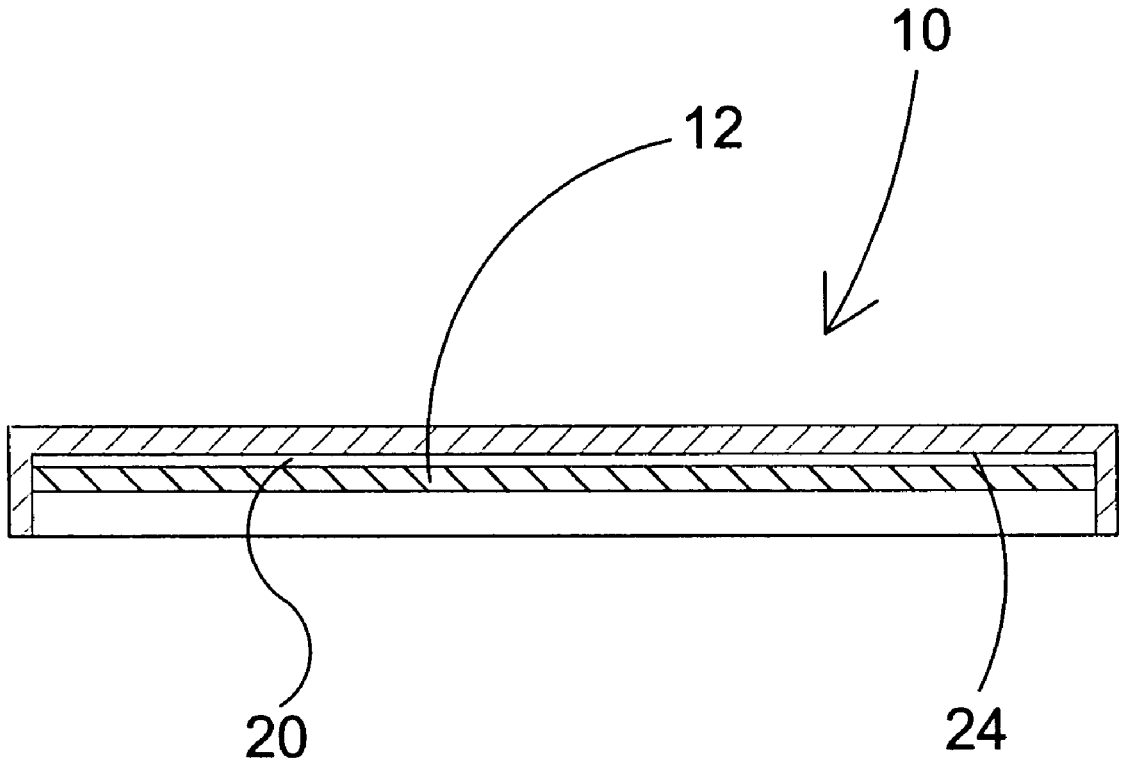
FIG. 7 is a sectional view of the present invention adhesively attached to the under side of the top step of a ladder.

Turning to FIG. 7, shown therein is a sectional view of the present invention 10 adhesively attached to the under side of the top step 24 of a ladder. Shown is a detailed view of the present invention 10 being a magnetic plate 12 that is fixedly attached to the under side of the top step 24 of a ladder by means of adhesive material 20 whereby ferriferous material items placed thereon will be magnetically held in position on the magnetic plate. The device 10 is designed to prevent items stored on the top step of a ladder from falling to the ground. Even if the ladder tips over, the ferriferous items upon the magnetic plate 12 will stay in place.

Figure 8:
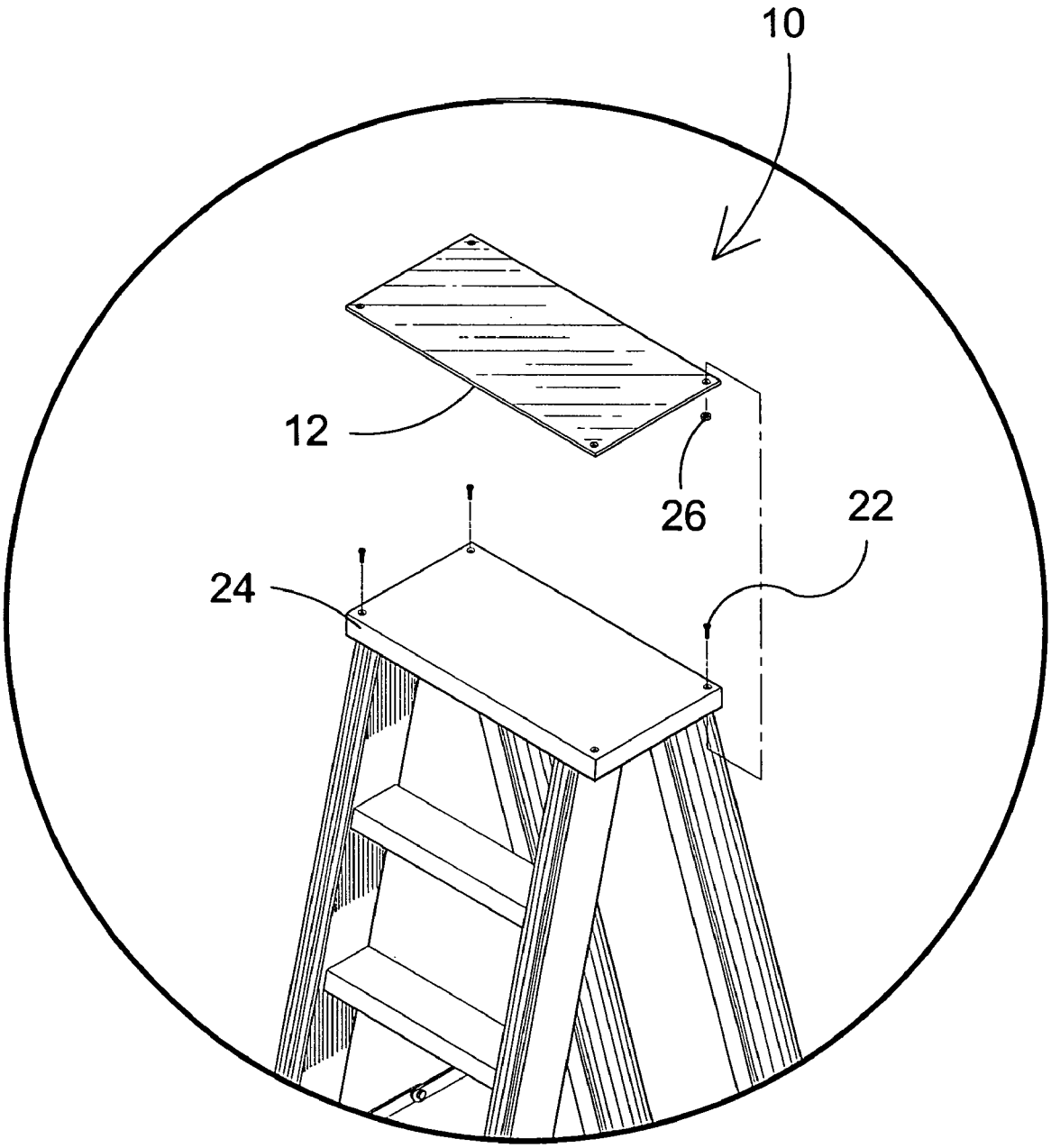
FIG. 8 is a detailed view of the present invention screw attached to the under side of the top step of a ladder.

Turning to FIG. 8, shown therein is a detailed view of the present invention 10 screw 22 attached to the under side of the top step 24 of a ladder. Shown is a detailed view of the present invention 10 being a magnetic plate 12 that is fixedly attached to the underside of the top step 24 of a ladder by means of recessed screws 22 with or without nuts 26 whereby ferriferous material items placed thereon will be magnetically held in position on the magnetic plate 12. The device 10 is designed to prevent items stored on the top step 24 of a ladder from falling to the ground. Even if the ladder tips over, the ferriferous items upon the magnetic plate 12 will stay in place.

Figure 9:
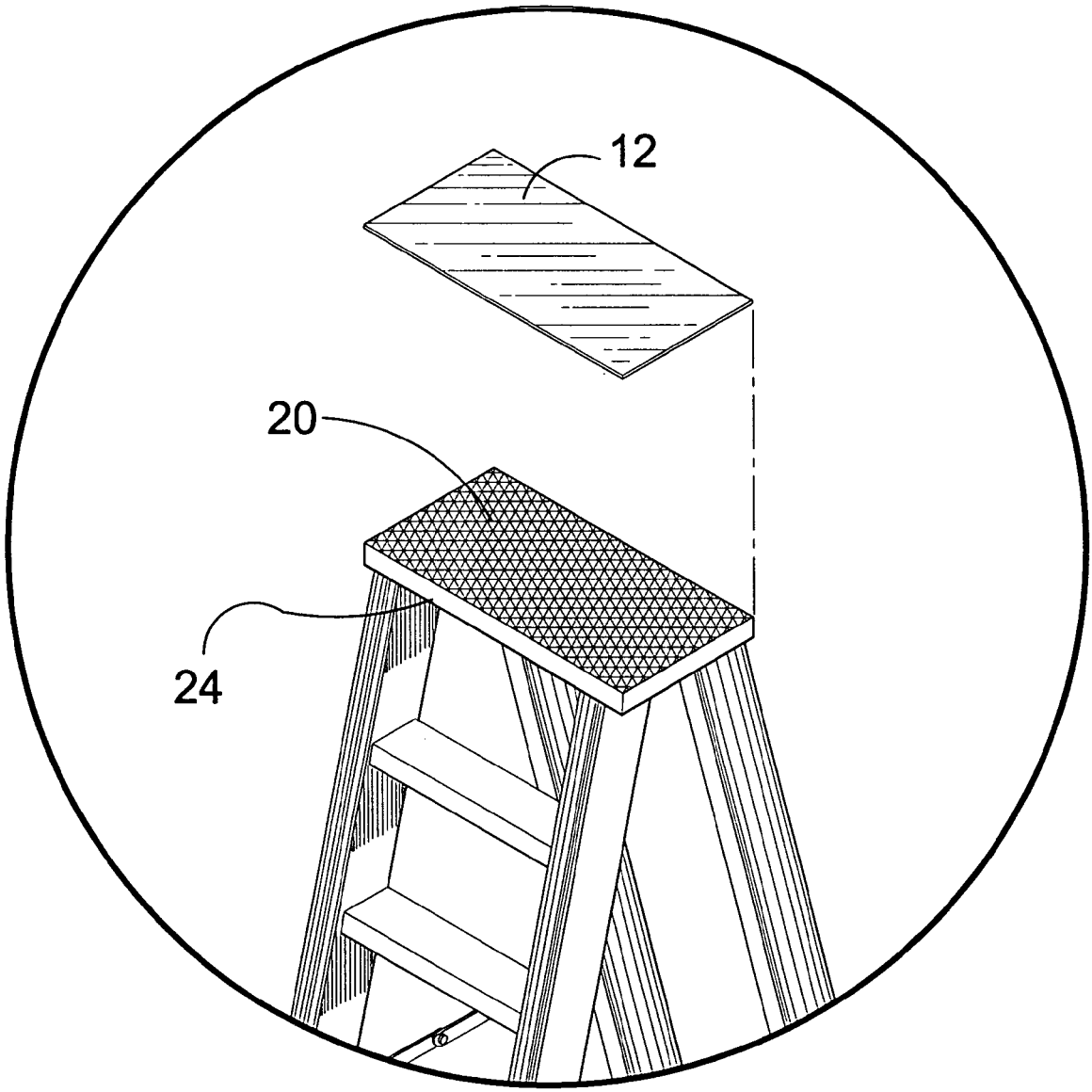
FIG. 9 is an illustrative view of the present invention adhesively attached to the top step of a ladder.

Turning to FIG. 9, shown therein is an illustrative view of the present invention 10 adhesively attached to the top step 24 of a ladder. Shown is the present invention 10 being a magnetic plate 12 that is fixedly attached to the top step 24 of a ladder by means of adhesive material whereby ferriferous material 20 items placed thereon will be magnetically held in position on the magnetic plate. The device 10 is designed to prevent items stored on the top step 24 of a ladder from falling to the ground. Even if the ladder tips over, the ferriferous items upon the magnetic plate 12 will stay in place.

Figure 10:
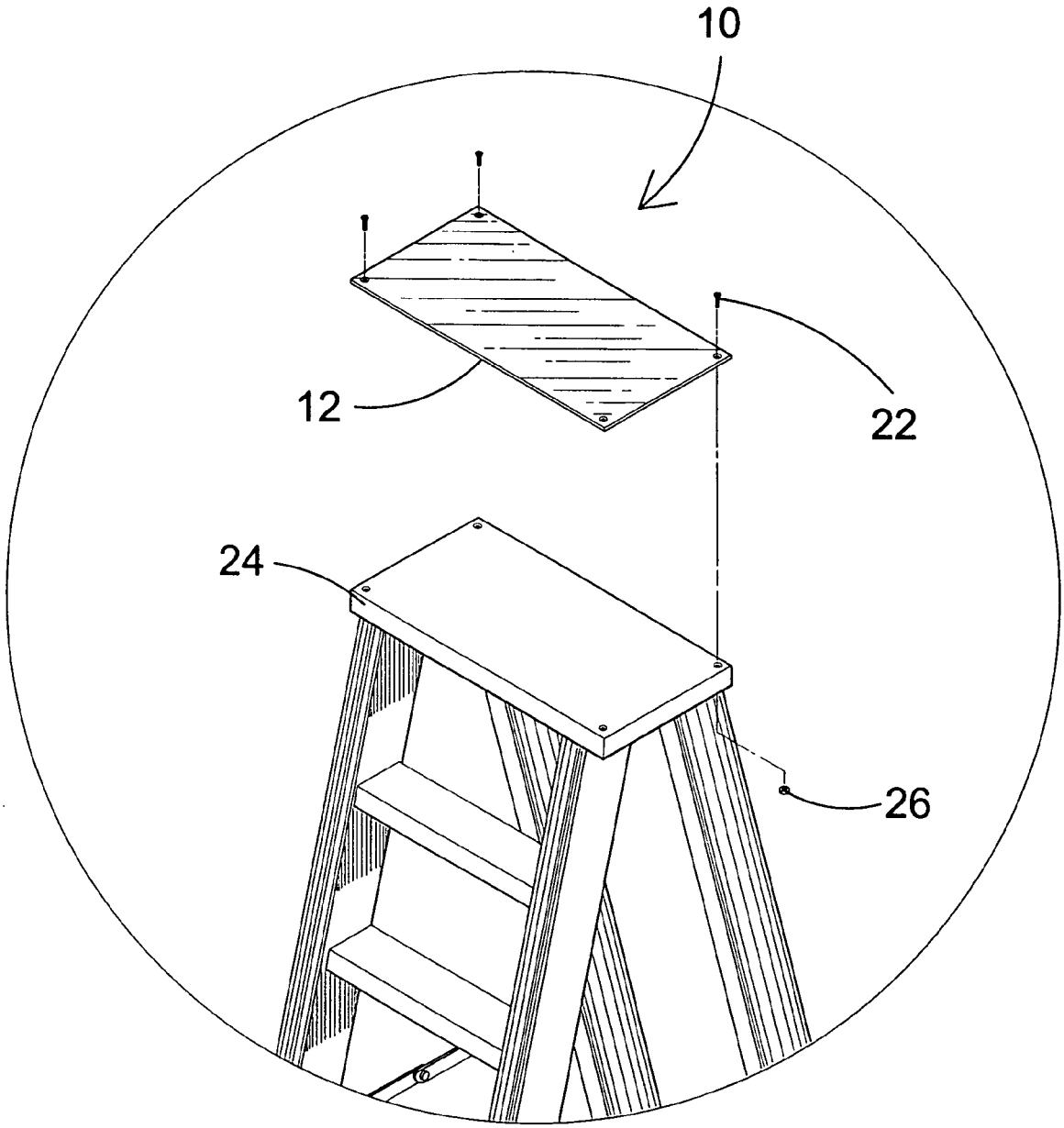
FIG. 10 is an illustrative view of the present invention fixedly attached to the top step of a ladder by means of screws.

Turning to FIG. 10, shown therein is an illustrative view of the present invention 10 fixedly attached to the top step 24 of a ladder by means of screws 22 with or without nuts 26. Shown is the present invention 10 being a magnetic plate 12 that is fixedly attached to the top step 24 of a ladder by means of recessed screws 22 whereby ferriferous material items placed thereon will be magnetically held in position on the magnetic plate. The device 10 is designed to prevent items stored on the top step 24 of a ladder from falling to the ground. Even if the ladder tips over, the ferriferous items upon the magnetic plate 12 will stay in place.

Figure 11:
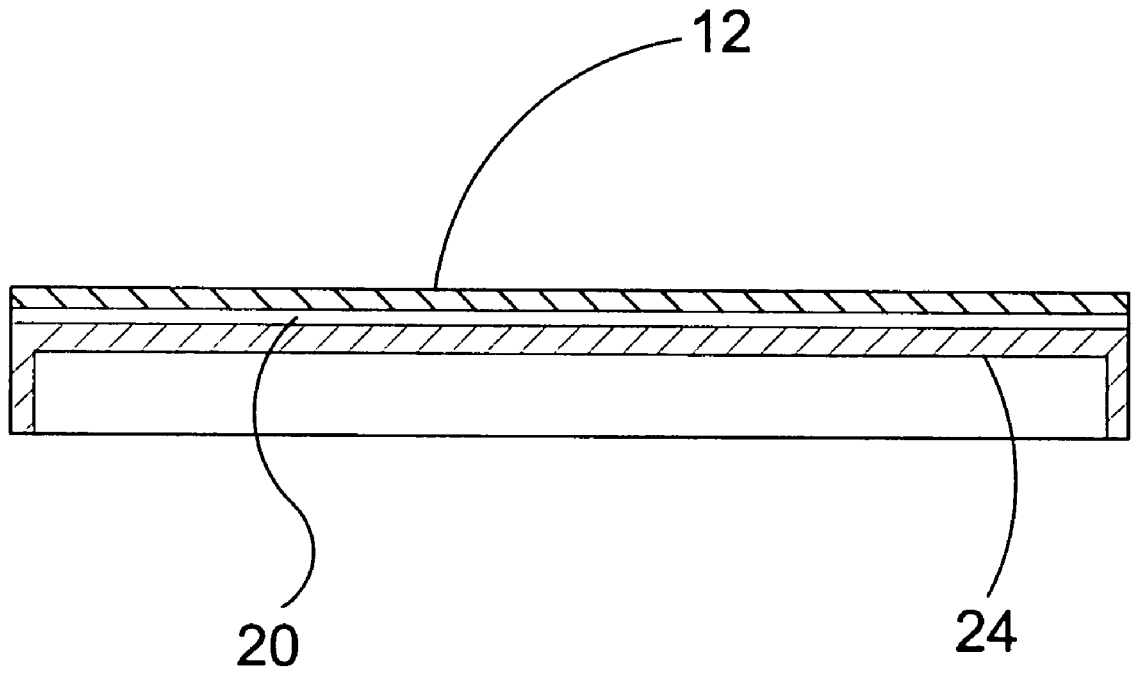
FIG. 11 is a sectional view of the present invention adhesively attached to the top step of a ladder.

Turning to FIG. 11, shown therein 1 is a sectional view of the present invention 10 adhesively attached to the top step 24 of a ladder. Shown is the present invention 10 being a magnetic plate 12 that is fixedly attached to the top side of the top step 24 of a ladder by means of adhesive material 20 whereby ferriferous material items placed thereon will be magnetically held in position on the magnetic plate. The device 10 is designed to prevent items stored on the top step 24 of a ladder from falling to the ground. Even if the ladder tips over, the ferriferous items upon the magnetic plate 12 will stay in place.

Figure 12:
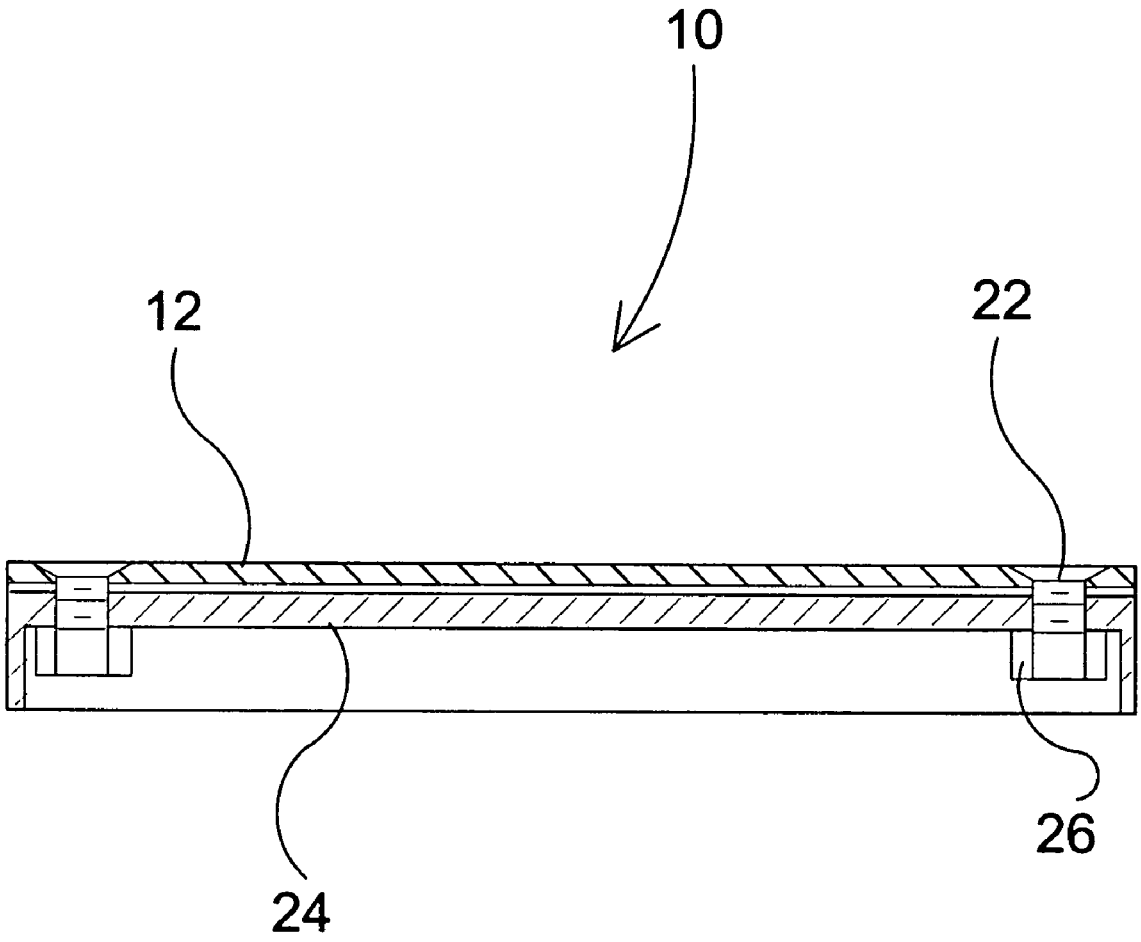
FIG. 12 is a sectional view of the present invention fixedly attached to the top step of a ladder by means of screws.

Turning to FIG. 12, shown therein is a sectional view of the present invention 10 fixedly attached to the top step 24 of a ladder by means of recessed screws 22 and nuts 26. Shown is the present invention 10 being a magnetic plate 12 that is fixedly attached to the top step 24 of a ladder by means of recessed screws 22 whereby ferriferous material items placed thereon will be magnetically held in position on the magnetic plate. The device 10 is designed to prevent items stored on the top step 24 of a ladder from falling to the ground. Even if the ladder tips over, the ferriferous items upon the magnetic plate 12 will stay in place.

Figure 13:
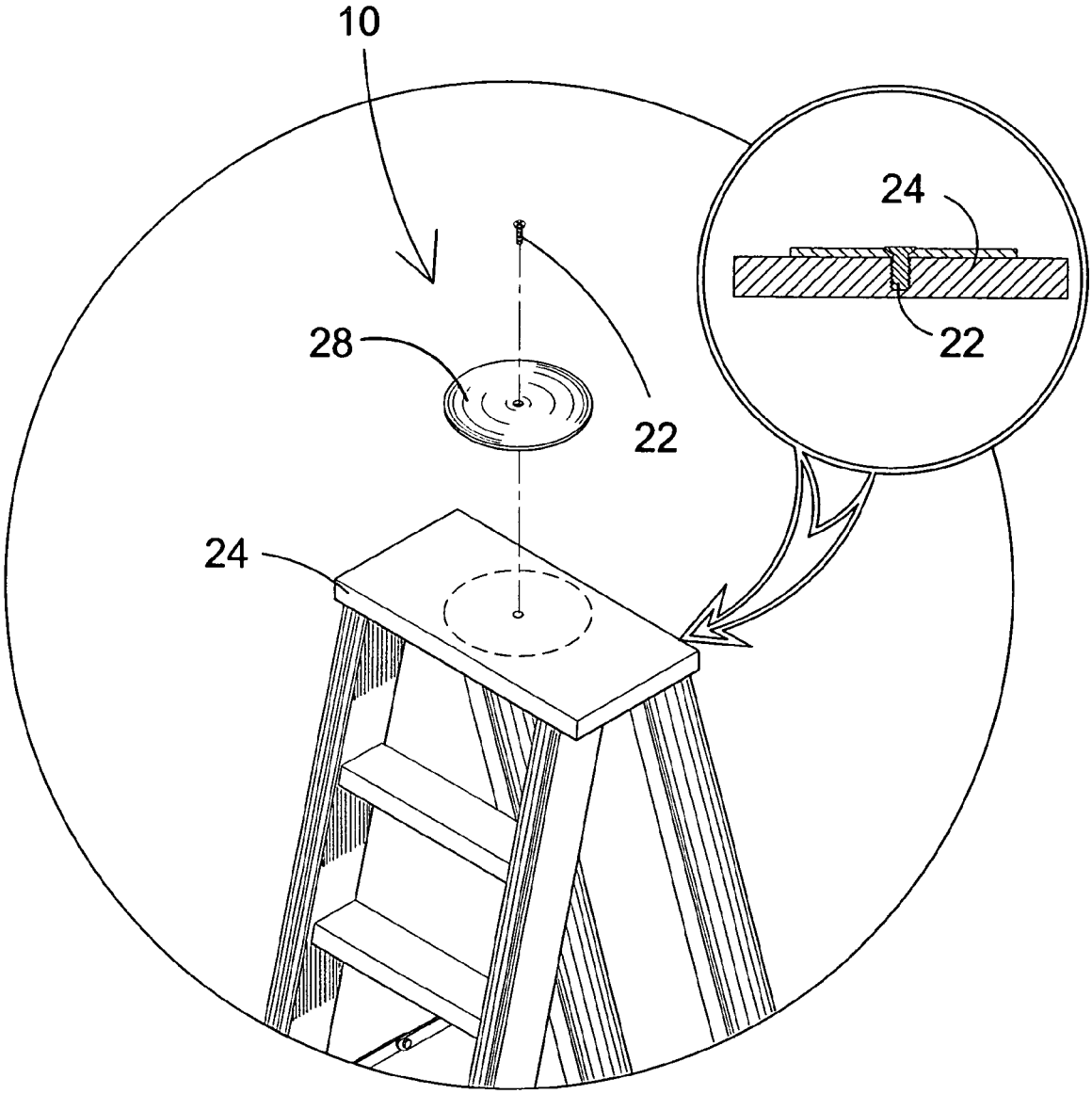
FIG. 13 is an illustrative view of an additional element of the present invention.

Turning to FIG. 13, shown therein is an illustrative view of an additional element of the present invention 10. Shown is the present invention 10 having a magnetic donut 28 affixed to the top step 24 of a ladder by a fastening means, typically a screw 22 being recessed, to allow for the user to have a smaller round area of magnetic attraction for the attachment of their tools thereto.

Figure 14:
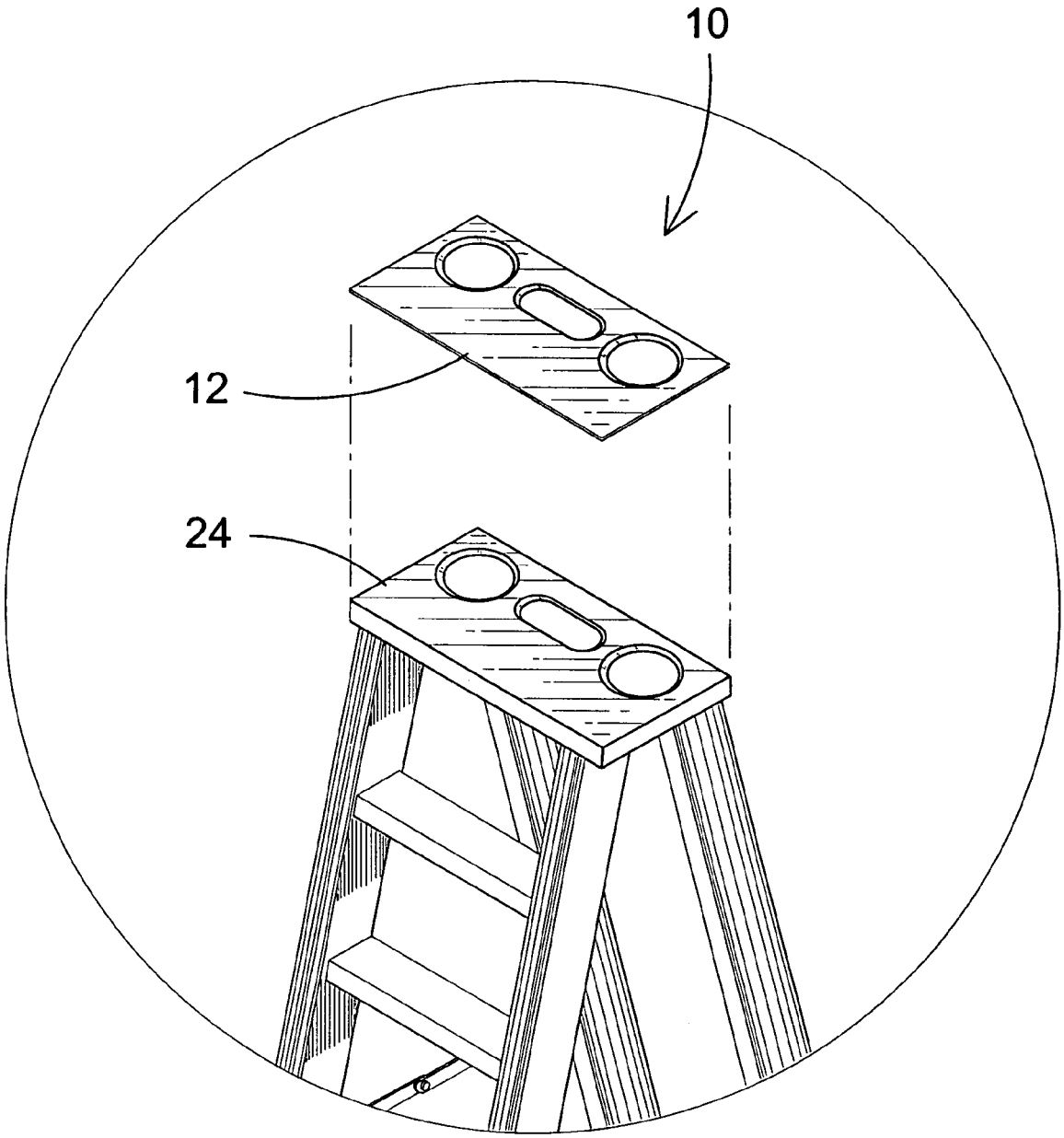
FIG. 14 is an illustrative view of the present invention comprising the magnetic plate manufactured of a magnetic material.

Turning to FIG. 14, shown therein is an illustrative view of the present invention 10 comprising the magnetic plate 12 manufactured of a magnetic material. Shown is the present invention 10 comprising a magnetic plate 12 manufactured to contour the surface of the top step 24 of existing ladders whereby users can purchase the magnetic plate for attachment, as previously disclosed herein, to the top or underside surface of their existing ladder top step. Attachment means can comprise any method well known in the prior art or as previously disclosed.

We claim:

1. A magnetic tool holder in combination with a step ladder comprising a magnetic plate fixedly attached to an under side of a top step of said ladder, said magnetic plate being complimentarily shaped as the top step and covering substantially all of a horizontal surface of the underside of the top step so that small tools and objects of ferriferous material placed on a top side of said top step are held magnetically in place when said step ladder is tipped.

2. The apparatus of claim 1, wherein said magnetic plate is held in place by the use of an adhesive layer disposed been said magnetic plate and the top step.

3. The apparatus of claim 1, wherein said said magnetic plate is held in place by the use of a plurality of fasteners connecting said magnetic plate and the top step.

4. The apparatus of claim 3, wherein said fasteners are screws.

5. The apparatus of claim 3, wherein said fasteners are nuts and bolts.

6. The apparatus of claim 3, wherein said fasteners are screws having recessed heads.

* * * * *